United States Patent [19]

Grahl et al.

[11] 4,255,940

[45] Mar. 17, 1981

[54] DISCHARGE LINE FILTER-DRYER

[75] Inventors: Darwin R. Grahl; Walter O. Krause, both of Newark, N.Y.

[73] Assignee: Parker-Hannifin Corporation, Cleveland, Ohio

[21] Appl. No.: 65,016

[22] Filed: Aug. 9, 1979

[51] Int. Cl.[3] ..... F25B 27/00

[52] U.S. Cl. ..... 62/324.3; 62/474

[58] Field of Search ..... 62/85, 195, 474, 475, 62/324

[56] References Cited

U.S. PATENT DOCUMENTS

| | | | |
|---|---|---|---|
| 3,175,342 | 3/1965 | Balogh | 62/474 |
| 3,178,022 | 4/1965 | Balogh | 62/474 |
| 3,221,478 | 12/1965 | Norton | 62/85 |
| 3,783,629 | 1/1974 | Phillips | 62/85 |
| 4,104,044 | 8/1978 | Lange | 62/324 |
| 4,180,988 | 1/1980 | Forte et al. | 62/474 |

*Primary Examiner*—Ronald C. Capossela

*Attorney, Agent, or Firm*—Joseph B. Balazs

[57] ABSTRACT

A heat pump system having a filter-dryer unit located in the discharge line of the compressor provides unidirectional operation of the filter dryer in a bidirectional system. The relatively high water retention capacity of molecular sieve desiccant at elevated temperatures allows operation of the filter-dryer at the outlet of the compressor while internal baffles in the unit, a specially sized housing and a spring loaded desiccant support structure accommodate the relatively high fluid velocity and other conditions encountered in the discharge line.

12 Claims, 4 Drawing Figures

DISCHARGE LINE FILTER-DRYER

BACKGROUND OF THE INVENTION

This invention relates to heat pump systems and more particularly to a filter-dryer unit capable of operation in the unidirectional fluid line at the output of a compressor in any system utilizing refrigerant fluid.

It is conventional in most refrigeration systems to utilize a filter-dryer in the system for filtering particles of solid foreign matter from the fluid and for adsorbing water, acids and other impurities. The solid contaminants might occur as casting sand, copper oxide and metal fine from manufacturing and assembly procedures as well as from wear during operation while chemical reactions within the system may form sludges and varnishes which plug orifices within the system or attack some of the components thereof.

It is well known to remove or control the quantity of such contaminants within the system in order to avoid excessive system failures. Further it is known to utilize a filter-dryer as a preventative maintenance tool whereby an initial clean-up of a newly installed system may be performed to remove manufacturing contaminants and those introduced at the time of assembly of the system and yet the filter-dryer can still be effective over the lifetime of operation of the system to maintain it in a high degree of cleanliness.

The filter-dryer is typically installed in the liquid line of a refrigeration system in order to avoid the high pressure drop which would result if the unit were installed in the portion of the system in which the refrigerant is in a vapor state. Pressure drop anywhere in the system reduces the refrigeration capacity, thereby increasing the energy requirements to cool a given load. Recently, the heat pump system has become very popular in the interests of energy conservation, such system acting as a reversible refrigerant system serving as an air conditioner during the summer months and as a heater during the cooler months. A heat pump system is effected by switching the direction of refrigerant flow in the liquid lines so that the role of the evaporator and the condenser are reversed. However, if a liquid line dryer is used in such a system, it would result in a condition of flow reversals in the dryer itself with a release of the contaminants trapped therein into the system. Many attempts have been made in order to accommodate such conditions including the use of dual liquid line dryers and check valves in order to route the flow of refrigerant in a unidirectional manner through each filter-dryer unit. Such installation however is costly due to the additional plumbing required and increases the probability of increased failures due solely to the additional number of components involved.

This problem could be avoided in the heat pump system by the introduction of the filter-dryer in either the discharge or suction line of the compressor where only unidirectional flow of fluid occurs. Suction line filter-dryers are in use but have been determined as not so desirable since they introduce a large pressure drop in this low refrigerant density fluid line, and the energy penalty is considerable. In the past the discharge line location has not been considered practical because of the relatively high temperature levels involved, which affects primarily the water retention capability of the desiccant within the filter-dryer unit. A filter-dryer located in the discharge line of the compressor, however would not result in such great energy penalty due to the relatively higher density of refrigerant in this line and could provide a significant cost advantage to the customer in avoiding the requirement for redundant liquid line units and accompanying switching devices.

U.S. Pat. No. 4,104,044 discloses one prior art solution to the use of filter-dryer assemblies in the heat pump system, using dual filter-dryers having internal check valves, the units being in parallel connection with dual expansion devices, and all components located in the liquid lines of the system.

U.S. Pat. No. 3,783,629 discloses one example of the use of a filter-dryer at the discharge side of the compressor. In this non-reversible refrigeration system, hot exhaust gas from the compressor is delivered initially to an enlarged pipe forming part of a jet ejector across which the filter-dryer is connected. It is stated that the combination of ejector and filter-dryer in this arrangement alleviates the problem of pressure drop in the system introduced solely by a filter-dryer, however it is apparent that only a portion of the refrigerant passes through the dryer unit in this bypass type system. Further, the filter-dryer is located a considerable distance from the outlet of the compressor being connected by means of the enlarged pipe and a further conduit, significantly also introducing cooling fins on the filter-dryer unit to allow the return of liquid to the downstream side of the jet ejector. Such type of system is apparently feasible only where there is adequate space available for such piping components and the large size filter-dryer unit indicated.

U.S. Pat. No. 3,175,342 depicts a filter-dryer unit in the discharge line of a compressor, stating that a conventional device may be so employed. In fact, this patent relates to the introduction of a clean-up filter in the suction line of the compressor as a temporary device when a new compressor or the like is installed in the system and suggests otherwise that a filter-dryer would be employed in the liquid lines of such system. It was conventional at that time to employ filter-dryers in the liquid line portion of the system and it is believed that the filter-dryers that were state-of-art as of the time of issuance of the patent would not have been suggested nor practical for application in the discharge line of a compressor in a refrigerating or heat pump system. This patent does not state that molecular sieve could be used as the desiccant in a discharge line dryer which would likely be necessary in order to have an operable unit and it is believed that the showing of a filter-dryer in the discharge line was inadvertent.

SUMMARY OF THE INVENTION

While the state-of-art indicates that, for efficiency, refrigeration filter-dryers should be installed in the liquid line of the system, it has been determined that a filter-dryer utilizing molecular sieve desiccant and of a particular configuration can be used in the discharge line of a compressor, either in a unidirectional refrigerating type system or a bi-directional heat pump type system. While it is typical in the prior art to use activated alumina or silica gel as the desiccant for liquid line dryers, the use of such materials at the discharge outlet of the compressor would be impractical due to the fact that the capability of such desiccant for holding water at temperatures above 140° F. falls off significantly.

Natural or synthetic zeolites, commonly known as molecular sieves, however, are not as temperature sensitive when used as a desiccant. It has been determined that such a desiccant can be employed in the temperature range encountered at the discharge line of the compressor in typical heat pump and refrigeration systems and still provide adequate water holding capability to suitably protect the system.

One of the reasons that it is not commonplace to locate the filter-dryer units in the suction or discharge lines of the compressor is the fact that the refrigerant fluid in these lines is at a relatively low density compared with that in the liquid line and a relatively high pressure drop would occur through the filter-dryer element. However, it has been determined that the density of the refrigerant in the discharge line of typical compressor units is sufficiently high so as not to incur an energy penalty by the introduction of a filter-dryer in the line, and this low level of pressure loss is further enhanced by the use of molecular sieve in the path of refrigerant flow.

Relatively high fluid velocities however are encountered in the discharge line of a compressor and it is necessary to provide means to prevent unnecessary agitation of the molecular sieve and consequent possible attrition of the desiccant material. Such result is achieved in the instant invention by the introduction of a filter structure which provides a reduced pressure zone in the discharge line, to reduce velocity and to allow sufficient time for the refrigerant fluid to contact the desiccant. The structure also resiliently supports the molecular seive and includes a baffle arrangement therein to provide an optimum path for fluid flow through the housing, avoiding direct impingement upon the molecular seive.

Additional advantages are obtained in locating the filter-dryer in the discharge line. Among these are that the unit acts as a noise muffler for the compressor and as a precooler for the condenser. It provides filter protection for the reversing valve and it is located in a position between the compressor and reversing valve where more space in typically available. Further it is more readily removed with the compressor after burnout situations so that less braze joints need be opened or remade.

DESCRIPTION OF THE PREFERRED EMBODIMENT

Figure 1:
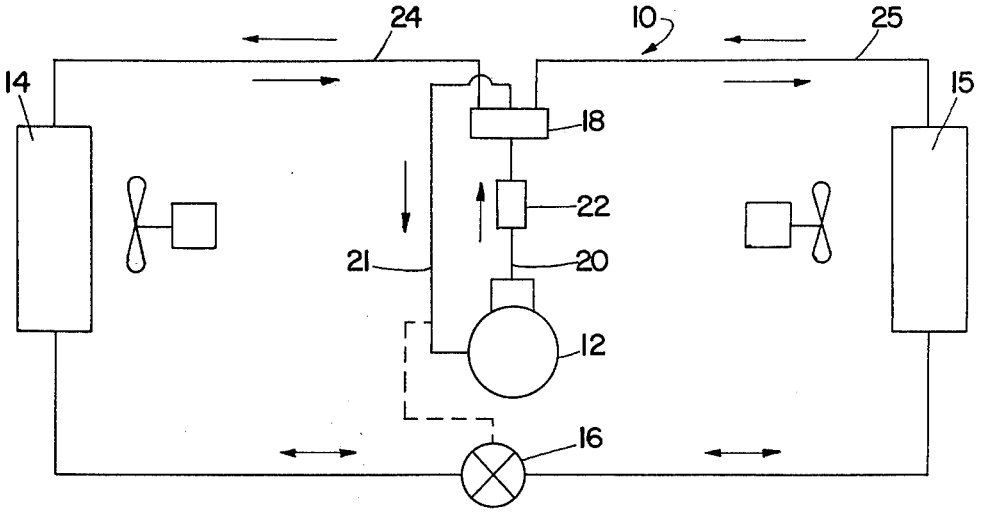
FIG. 1 is a schematic drawing of a typical reversible heat pump system showing the filter-dryer of the invention located in the discharge line of the compressor for the system.

Referring now to the drawings the heat pump system 10 according to the present invention has a conventional compressor 12, a first heat exchanger 14, a second heat exchanger 15, an expansion valve 16 and a reversing valve 18 for selecting between heating and cooling modes of the heat pump system.

The compressor 12 has a discharge line outlet 20 and a suction line inlet 21, the latter being connected as the return from the reversing valve 18 and the former connected as the inlet to the reversing valve 18 by means of the filter dryer 22 of the instant invention.

Fluid flow through the heat pump system 10 is in the direction of the arrows indicated in FIG. 1, it being noted that the flow in the discharge line 20 and suction line 21 is unidirectional while that in the remainder of the system comprising the heat exchangers 14, 15 and the expansion valve 16 is bi-directional depending upon the setting of the reversing valve 18.

Assuming for example that the selector valve 18 is moved to a position to provide fluid flow throughout the system in the direction of the upper arrows of FIG. 1 it will be noted that the following operation occurs. The compressor 12 is typically a motor driven thermostatically controlled compressor acting upon refrigerant fluid received from suction line 21 to provide pressurized refrigerant fluid in a vapor state at discharge line conduit 20, being routed in turn to the filter-dryer 22 and reversing valve 18. Fluid flow continues in the vapor state through conduit 24 to the first heat exchanger means 14, in this instance being a condenser unit, whereupon the refrigerant is cooled to the liquid state with the thus heated air being exhausted by means of the associated fan. The liquid refrigerant is delivered by means of a further conduit to expansion valve 16 and second heat exchanger means 15, the latter in this instance comprising an evaporator coil structure which assists in vaporization of the refrigerant, the required heat being obtained from the air driven over the evaporator coil by means of the associated fan and being exhausted as cooling air therefrom. The again vaporized refrigerant is returned by means of conduit 25 to reversing valve 18 and thus to the suction line 21 of the compressor for further cycling. In such a system the expansion valve 16 and the associated conduits connecting same are considered the liquid lines while the remainder of the system comprising the heat exchange means 14, 15, conduits 24, 25, suction line 21 and discharge line 20 comprise the portion of the system in which the refrigerant occurs primarily in a vapor state.

It will be understood that by changing the condition of reversing valve 18 so as to effect refrigerant flow in the direction of the lower arrows in FIG. 1, refrigerant will be delivered from the reversing valve 18 initially to conduit 25 and eventually be returned by way of conduit 24. In such mode of operation the second heat exchange means 15 will comprise the condenser and the first heat exchange means 14 the evaporator, while expansion occurs through a common expansion valve 16.

It will be appreciated that the refrigerant fluid in the discharge line 20 of the compressor 12 will be relatively dense compared with the density of the fluid occurring in the suction line 21. Further the velocity of the fluid in the discharge line 20 will be substantially higher than the velocity of the fluid in the liquid lines of the system, it being understood that a continuous flow of refrigerant in both the vapor and liquid states occurs throughout the system 10.

Figure 2:
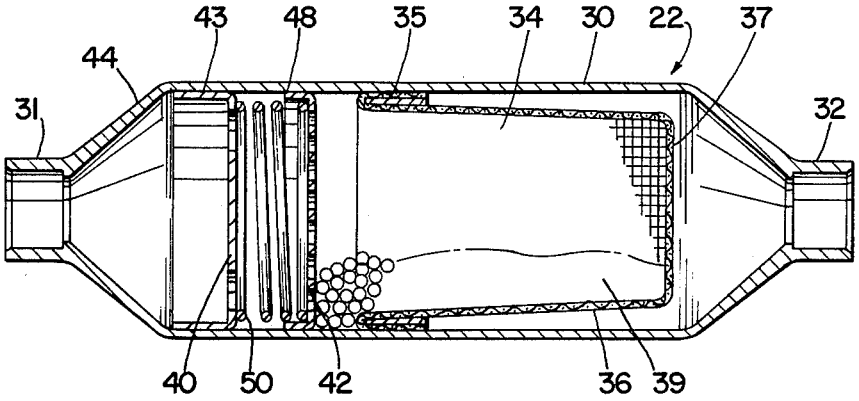
FIG. 2 is a cross-sectional view in elevation of a preferred embodiment of filter-dryer.
Figure 3:
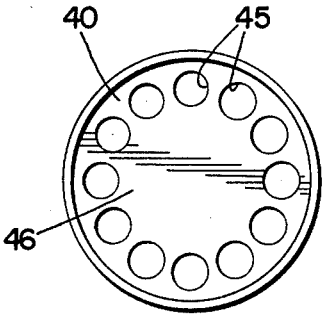
FIGS. 3 and 4 are left-end views of the first and second baffles, respectively, located in the filter-dryer housing.
Figure 4:
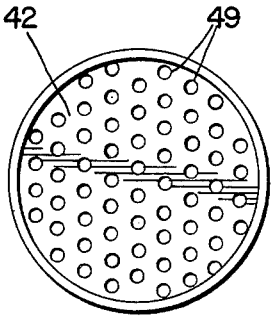

Referring now to FIG. 2 a preferred embodiment of filter-dryer is indicated generally by the arrow 22 as comprising a tubular housing 30 having a necked-down inlet 31 and a similarly necked-down outlet 32 at either end of the housing. The housing is shown of one-piece construction in the preferred embodiment of the invention but it will be understood that other configurations may be employed as well in order to house the further components of the filter-dryer therein and provide a structure for routing of the refrigerant fluid therethrough.

A screen assembly is contained within the housing 30 consisting of a cup-shaped filter basket 34 retained in place near the outlet of the housing 30 by means of a double-folded marginal flange 35 thereon which fixedly engages the inner surface of the housing wall. The filter basket 34 has a gently tapered side wall 36 providing a slightly conical configuration and an end wall 37 of the same material forming the remainder of the filter basket. In this embodiment of the invention the filter basket 34 consists of relatively fine wire mesh which serves as a filter for enlarged particles within the system and also serves to contain desiccant 39 therein.

The desiccant 39 used in this invention is molecular sieve which may be a naturally occurring or synthetic zeolite or other similar material. The molecular sieve is a crystalline aluminosilicate material belonging to the class of minerals known as zeolites and having the outstanding characteristic of being able to undergo dehydration with little or no change in crystal structure. The dehydrated crystals are interlaced with regularly spaced channels of molecular dimensions and this network of uniform pores comprises almost 50% of the total volume of the crystals. The molecular sieve is not as temperature sensitive as other desiccants and it has been determined for example that molecular sieve type 4A-XH6 manufactured by Union Carbide Corporation has a suitable water capacity at elevated temperatures that it can be applied to discharge line service which is on the order of 200°-250° F. and still retain adequate water capacity for system protection.

It should be understood that standard desiccant materials commonly employed in refrigeration such as activated alumina and silica gel are substantially valueless in water retention properties at such elevated temperature levels as occur at the discharge of a refrigeration compressor. Similarly while the molecular sieve has less water capacity at such higher temperature levels than at the standard temperature levels typically encountered in liquid line applications where molecular sieve is commonly employed, it has been determined that the molecular sieve will have sufficient water capacity to be useful for system protection. It has been determined further, that in order to obtain adequate protection from the standpoint of water capacity in the desiccant material, it is necessary to provide more desiccant than would be used in a typical state-of-the-art liquid line dryer and further, if a reasonable lifetime is needed, to employ special techniques to protect the desiccant from the conditions encountered at the discharge line of the compressor.

The desiccant 39 is retained in the filter basket 34 by means of a dual baffle arrangement consisting of a first baffle 40 near the inlet 31 of the housing 30 and a second baffle 42 between the first baffle 40 and the filter basket 34. First baffle 40 has a peripheral flange 43 thereon and is sized to be frictionally engaged by the inner wall of the housing 30 or to be urged to a position engaging the conical wall 44 of the filter-dryer housing. The transverse wall of the first baffle 40 has a plurality of perforations 45 on the order of ¼ inch diameter spaced about the periphery thereof and a substantially closed central section 46.

Second baffle 42 also includes a peripheral flange 48 being sized for slidable movement within the housing 30, the transverse face of the baffle 42 having a plurality of perforations 49 thereon substantially evenly distributed over the face thereof, the total perforated area of the slidable baffle 42 being substantially the same as the perforated area of the first baffle 40. A coiled spring 50 is disposed between the first and second baffles 40, 42 and lightly urges the latter against the desiccant material 39 contained within the filter basket 34 to retain same therein, the perforations 49 being suitably sized to prevent passage of desiccant granules therethrough.

Thus it may be seen that as refrigerant fluid under pressure is received at the inlet 31 of the filter-dryer 22 an initial reduction in velocity of the fluid occurs in the transition of the fluid through the zone within the conical wall 44 into the larger chamber of the housing 30 thereby providing initially a measure of decreased agitation of the dessicant 39. Further a direct path of flow of the refrigerant fluid from the inlet 31 onto the desiccant 39 is prevented by the closed central portion 46 of the first baffle 40 requiring instead that the fluid be diverted through the perforations 45 near the periphery of the baffle. Continued flow of refrigerant through the perforations 49 of the second baffle 42 cause further dispersion of the fluid so that a relatively gentle flow occurs through the desiccant 39. A still further advantage of the structure of this embodiment of the invention is the bias placed upon the desiccant 39 by the spring loaded second baffle 42 under urging of the spring 50. This arrangement provides a continuous mild force upon the desiccant 39 again preventing undue agitation of same due to the flow of fluid therethrough and vibration conditions encountered, and further provides an automatic take up for any spalling or settling of the desiccant granules which occurs. These means control the condition of agitation sufficiently in order to enhance the lifetime of the filter-dryer unit.

The heat pump system 10 of the preferred embodiment of the invention employs Refrigerant 22 as the fluid therein and it has been determined that a filter-dryer housing on the order of 2¼ inch diameter may be employed containing on the order of 50 grams of desiccant 39 in a 3 ton heat pump system. The desiccant will have approximately 10% by weight capacity for water at 250° F. and at this level will provide suitable drying.

It will be noted as well that the arrangement of baffles 40, 42 and the perforations therein provide a dispersing and reflecting effect upon sound waves in the system and serve to muffle same, this being a particular advantage of locating the dryer 22 in the discharge line. Further, with an enlarged housing 30 of metal and a preferred flow path for the fluid along the periphery of the housing as routed by the baffles 40, 42 and associated structure, suitable heat-exchange with the atmosphere occurs so that the dryer 22 acts as a pre-cooler for the condenser.

In replacement of dual liquid-line dryers of the prior art, the apparatus of this invention provides further economics in requiring fewer components and connections and also effects a savings in the quantity of refrigerant required for a similar size system in that the displacement of a second dryer is saved.

I claim:

1. A refrigerating system, comprising compressor means having a discharge outlet for delivery of pressurized fluid to the system, condenser means for cooling the pressurized fluid to a liquid state, expansion and evaporator means for converting the liquid back to the gaseous state for return to said compressor means, and a dryer connected between the discharge outlet of said compressor means and said condenser means, said dryer having molecular sieve as the desiccant material therein, said dryer being directly connected to said discharge outlet of said compressor means and having means for supporting said molecular desiccant material in the path of flow of pressurized fluid from said compressor means so that substantially all of said pressurized fluid flows over said desiccant material.

2. The refrigerant system set forth in claim 1 wherein said dryer comprises means for supporting said molecular sieve in the path of flow of pressurized fluid from said compressor means, and means for changing the velocity of flow of pressurized fluid prior to passage through said molecular sieve.

3. The refrigerant system set forth in claim 1 wherein said dryer comprises means for changing the velocity of flow of pressurized fluid prior to passage through said molecular sieve, said velocity changing means comprising baffle means for redirecting the flow of pressurized fluid from a central path to a peripheral path and then to a dispersed path to provide a reduced velocity flow over said desiccant material.

4. A bidirectional heat pump system for heating or cooling purposes, comprising compressor means for pressurizing refrigerant fluid, said compressor means having a low pressure inlet and a high pressure outlet, first heat exchange means, expansion means and second heat exchange means for changing the state of the refrigerant fluid from vapor to liquid and back to vapor and for transferring heat therewith, means in connection with said compressor means for directing the flow of pressurized fluid through said heat exchange means into a heating or cooling mode, and filter-dryer means in connection with said compressor means between said high pressure outlet thereof and said directing means, for filtering and drying the pressurized refrigerant fluid supplied to said directing means and said heat exchange means independently of the selected heating or cooling mode of said directing means.

5. The heat pump system set forth in claim 4 wherein said filter-dryer means comprises molecular sieve having relatively high water retention capability at elevated temperatures.

6. The heat pump system set forth in claim 5 wherein said filter-dryer further comprises a tubular structure for supporting a bed of said molecular sieve desiccant therein, and means for diverting the flow of the refrigerant fluid from the axis of said tubular structure, thereby to lower the velocity thereof to prevent excessive agitation of said molecular sieve desiccant.

7. In combination, a motor driven compressor having suction and discharge lines for delivering refrigerant under pressure, a reversing valve coupled to said compressor for changing the direction of flow of said refrigerant, heat exchange means in fluid connection with said reversing valve for receiving high pressure refrigerant vapor from said compressor and for returning low pressure refrigerant vapor, and a molecular sieve dryer in fluid connection between the discharge line of said compressor and said reversing valve for cleaning contaminants from said refrigerant, said drier being subject only to unidirectional flow of refrigerant from the discharge line of said compressor.

8. A filter-dryer for use in the discharge line of a compressor in a reversible heat pump system, comprising a housing having an inlet for receipt of high pressure, high temperature refrigerant fluid from the outlet of a refrigerant compressor, and an outlet for delivering same to a heat pump system, means in said housing for resiliently supporting a bed of molecular sieve desiccant in a lightly packed condition, means in said housing for reducing the velocity of flow of refrigerant therein prior to contact of said refrigerant with said bed of desiccant, and means in said housing between said inlet thereof and said bed of desiccant for preventing the direct flow of said refrigerant to said bed of desiccant, thereby to prevent excessive agitation of said desiccant.

9. A discharge line filter-dryer for refrigerant fluid, comprising a tubular housing having substantial coaxial inlet and outlets, and a central portion therebetween, a deep, cup-shaped filter screen disposed in said central portion near the outlet of said housing, means for retaining said filter screen in substantial coaxial alignment with said tubular housing, a first perforated baffle fixedly disposed in said housing, a second perforated baffle slidably disposed in said housing between said first baffle and said filter screen, molecular sieve desiccant granules disposed in said filter screen and engaged by said second baffle, and a coiled spring between said first and second baffles for urging the latter into engagement with said desiccant to lightly compact same to prevent excessive relative movement of said desiccant granules, one of said baffles having a closed central portion to prevent direct flow of refrigerant fluid from said inlet to said desiccant granules to further prevent excessive agitation of same.

10. The filter-dryer set forth in claim 9 wherein said central portion of said housing is of greater diameter than said inlet in order to effect a reduction in velocity of refrigerant flow through said desiccant granules.

11. The filter-dryer set forth in claim 10 wherein said first baffle is perforated adjacent the periphery thereof and said second baffle is substantially uniformly perforated over the surface thereof.

12. The filter-dryer set forth in claim 11 wherein the area of perforations of said first and second baffles are substantially the same.

* * * * *